US005992667A

United States Patent [19]

Huang

[11] Patent Number: 5,992,667

[45] Date of Patent: Nov. 30, 1999

[54] CONTAINER CAP WITH A DETACHABLE FOLDING UTENSIL

[76] Inventor: Shou-Li Huang, 2F., No. 3, Lane 44, Torng Der St., Peitou, Taipei, Taiwan

[21] Appl. No.: 09/114,044

[22] Filed: Jul. 13, 1998

[51] Int. Cl.[6] ..... A47J 43/28; B65D 25/52

[52] U.S. Cl. ..... 220/212; 220/265; 220/735; 206/541; 30/123; 30/322; 30/324; 426/115

[58] Field of Search ..... 220/212, 265, 220/266, 268, 735; 215/228, 390, 391, 386; 206/217, 542, 541, 553, 216; 426/115; 30/322, 324, 123

[56] References Cited

U.S. PATENT DOCUMENTS

| | | | |
|---|---|---|---|
| 3,955,742 | 5/1976 | Marshall et al. | 220/212 |
| 4,615,120 | 10/1986 | Newman | 30/324 |
| 4,788,862 | 12/1988 | Fuller | 30/324 X |
| 4,826,033 | 5/1989 | Satoh | 30/322 |
| 5,419,049 | 5/1995 | MacArthur-Onslow | 30/322 |
| 5,491,897 | 2/1996 | Michelena | 30/324 X |
| 5,695,084 | 12/1997 | Chmela et al. | 220/212 |
| 5,705,212 | 1/1998 | Atkinson | 220/212 X |

FOREIGN PATENT DOCUMENTS

| | | | |
|---|---|---|---|
| 943781 | 3/1974 | Canada | 30/324 |
| 632970 | 11/1982 | Switzerland | 220/212 |
| 93/00848 | 1/1993 | WIPO | 30/322 |

*Primary Examiner*—Stephen K. Cronin
*Assistant Examiner*—Nathan Newhouse
*Attorney, Agent, or Firm*—Bacon &Thomas

[57] ABSTRACT

A plastic container cap includes a cap body having a rim and a face panel suspended within the rim, a folding utensil formed of a utensil body and a handle and integral with the face panel of the cap body wherein the utensil body, which can be a bowl or a fork, has a peripheral edge spaced from the face panel by a narrow opening and connected to the face panel by connecting portions in the narrow opening, and a neck at one end connected to the handle; the handle is hinged to the neck of the utensil body, having dented lines through which the handle is folded up and attached to the face panel of the cap body at a top side above said utensil body.

11 Claims, 7 Drawing Sheets

CONTAINER CAP WITH A DETACHABLE FOLDING UTENSIL

BACKGROUND OF THE INVENTION (a) Field of the Invention

The present invention relates to a container cap for a food container, and more particularly to such a container cap which is integral with a detachable folding utensil.

(b) Description of the Prior Art

A food container may be covered with a plastic cap to hold an attached utensil on the inside. The attached utensil is comprised of two separate parts, namely, the bowl (or fork body) and the handle. When in use, the bowl and the handle are disconnected from the plastic cap, and then fastened together by a plugging a plug rod at the handle into a plug hole at the bowl. Because the attached utensil is formed of two separate parts, its manufacturing cost is relatively high. Further, during the installation of the attached utensil, the attached utensil tends to be contaminated due to direct contact of the worker's hands.

SUMMARY OF THE INVENTION

It is one object of the present invention to provide a container cap which is integral with a detachable folding utensil. It is another object of the present invention to provide a container cap integral with a detachable folding utensil which enables the folding utensil, when detached from the container cap, to be arranged into a three-dimensional profile for the gripping of the hand conveniently positively. According to one aspect of the present invention, the plastic container cap comprises a cap body having a rim and a face panel suspended within the rim, a folding utensil formed of a utensil body and a handle and integral with the face panel of the cap body wherein the utensil body, which can be a bowl or a fork, has a peripheral edge spaced from the face panel by a narrow opening and connected to the face panel by connecting portions in the narrow opening, and a neck at one end connected to the handle; the handle is hinged to the neck of the utensil body, having dented lines through which the handle is folded up and attached to the face panel of the cap body at a top side above said utensil body. According to another aspect of the present invention, the dented lines include two longitudinally extended dent lines and two transversely extended dent lines, the longitudinally extended dent lines dividing the handle into an intermediate panel and two side panels hinged to the intermediate panel at two opposite sides, the intermediate panel having a plurality of plug holes, the side panels each having a plurality of plug rods, which are engaged into the plug holes on the intermediate panel when the utensil body is detached from the face panel of the cap body and side panels are folded up, the transversely extended dented lines being arranged in parallel adjacent to the rim of the cap body and, enabling the handle to be folded into a collapsed condition and attached to the face panel of the cap body at a top side, or a three-dimensional profile for the gripping of the hand.

DETAILED DESCRIPTION OF THE PREFERRED EMBODIMENT

Figure 1:
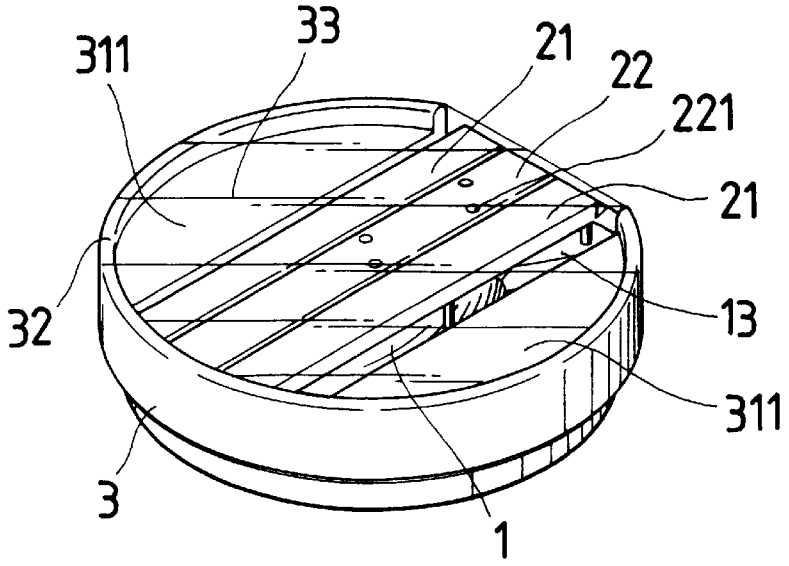
FIG. 1 is a perspective view of a container cap according to one embodiment of the present invention.
Figure 2:
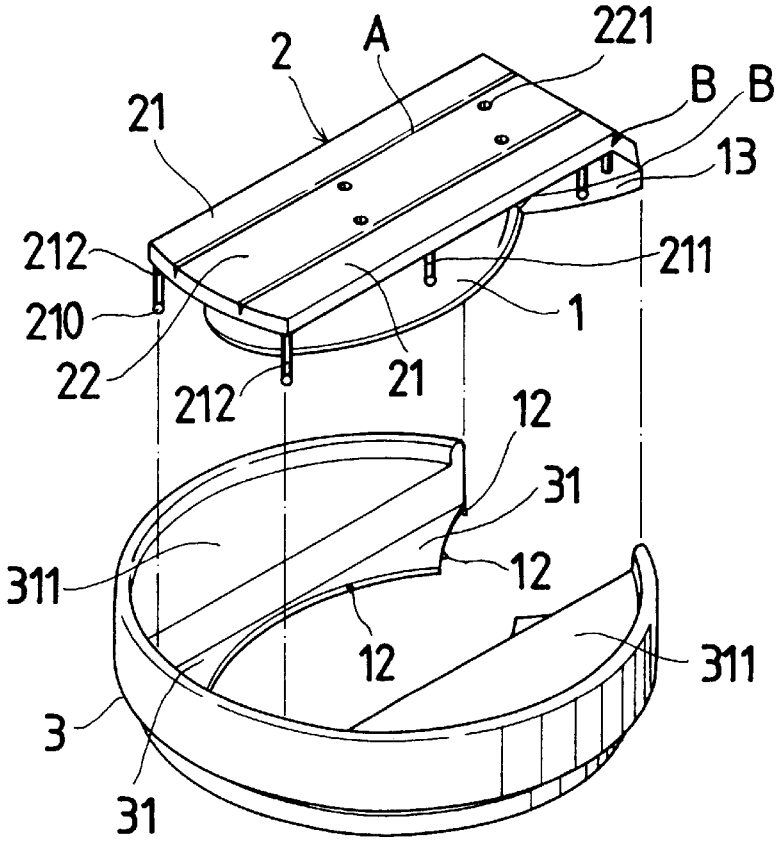
FIG. 2 is an exploded view of the container cap shown in FIG. 1.

Referring to FIGS. 1 and 2, a plastic container cap 3 is shown having a face panel 31 and a folding utensil for example a spoon, which is comprised of a bowl 1 and a handle 2 and integral with the face panel 31 of the plastic container cap 3. The bowl 1 and the handle 2 can be detached from the face panel 31 of the plastic container cap 3.

Referring to FIGS. from 3 through 8 and FIGS. 1 and 2 again, the bowl 1 is peripherally spaced from the face panel 31 by a narrow opening 11, and peripherally connected to the face panel 31 by connecting potions 12 in the opening 11. The bowl 1 has a neck 13 at one end hinged to the handle 2.

Figure 3:
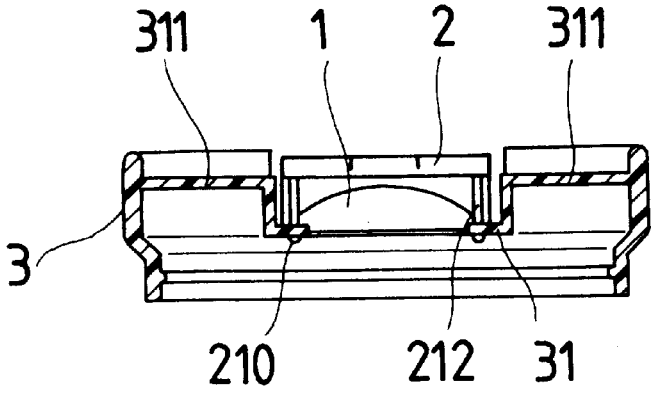
FIG. 3 is a sectional view of the container cap shown in FIG. 1.
Figure 4:
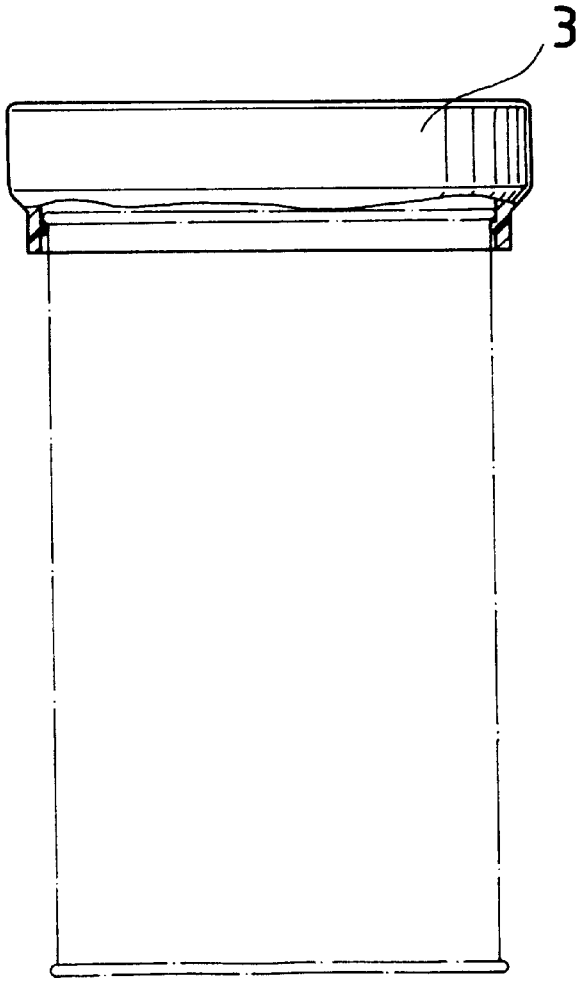
FIG. 4 shows the container cap fastened to a food container according to the present invention.
Figure 5:
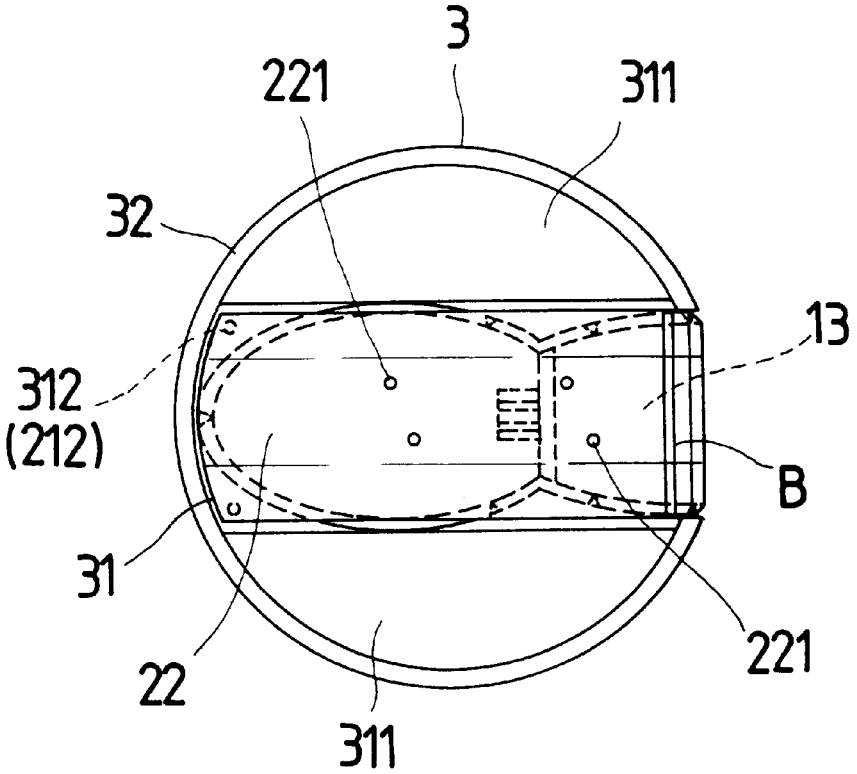
FIG. 5 is a top plain view showing the handle folded up and attached to the face panel according to the present invention.
Figure 6:
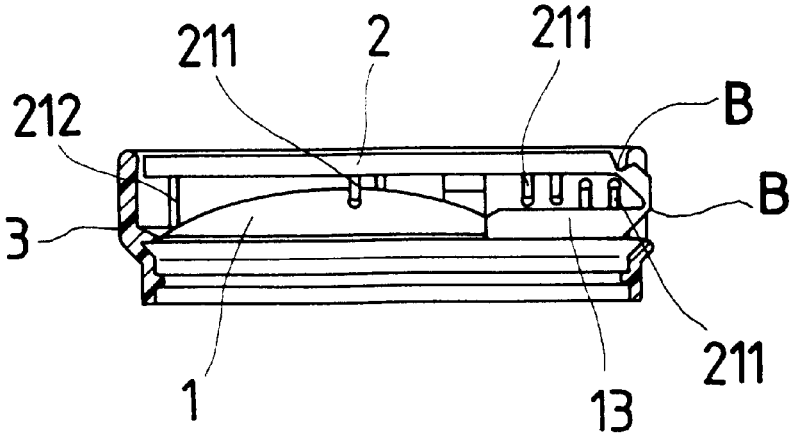
FIG. 6 is a side view of FIG. 5.
Figure 7:
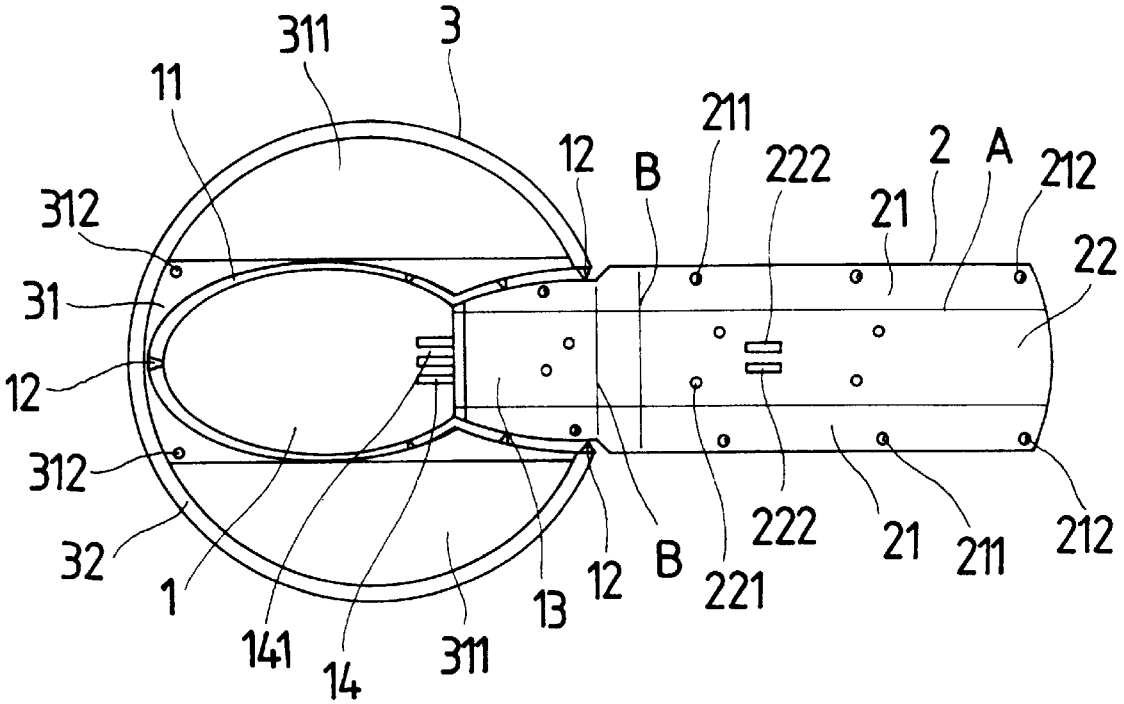
FIG. 7 shows the handle extended out of the container cap.
Figure 8:
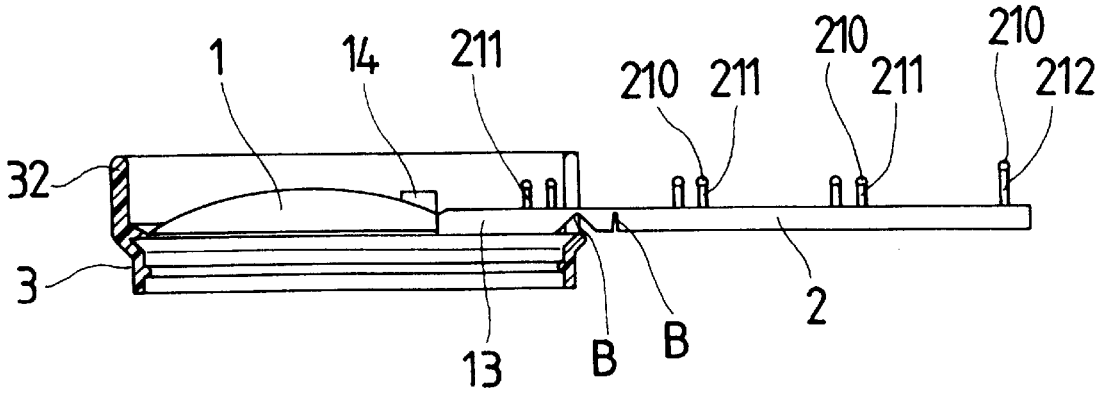
FIG. 8 is a side view of FIG. 7.
Figure 10:
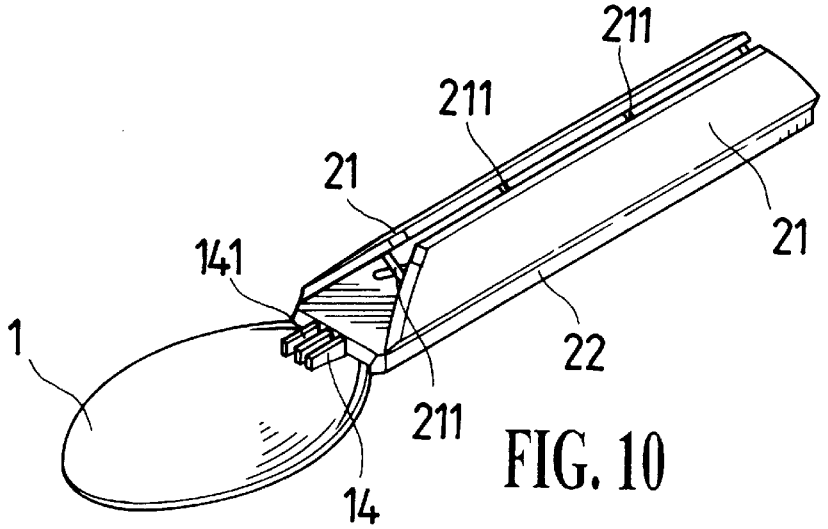
FIG. 10 is similar to FIG. 9 but showing the side panels of the handle folded up.
Figure 11:
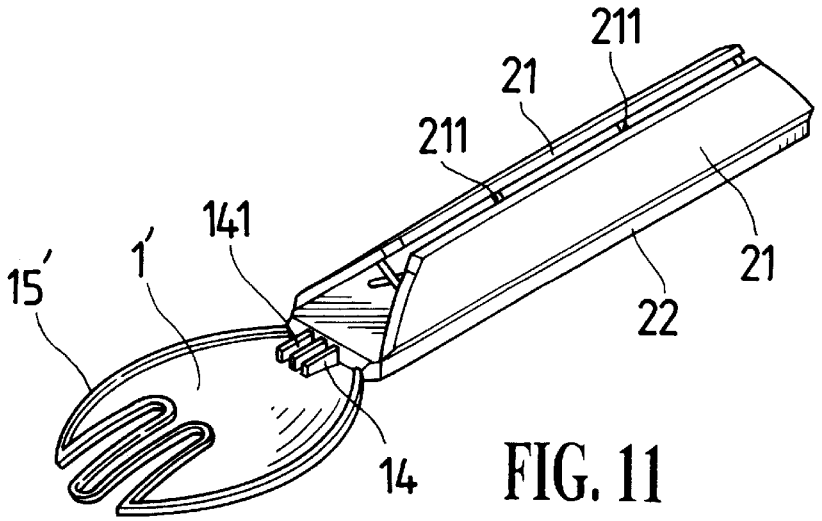
FIG. 11 shows an alternate form of the folding utensil according to the present invention.

The handle 2 has one end hinged to the neck 13 of the bowl 1. When the handle 2 and the neck 13 are extended out, two longitudinally extended dented lines A and two transversely extended dented lines B are formed at one side, namely, the top side (see FIGS. 7 and 8). The longitudinally extended dented lines A divides the handle 2 into an intermediate panel 22, and two side panels 21 bilaterally hinged to the intermediate panel 22. The intermediate panel 22 comprises a plurality of plug holes 221. The side panels 21 each comprise a plurality of plug rods 212. Through the longitudinally extended dented lines A, the side panels 21 can be turned upwards from the intermediate panel 22 and turned inwards toward each other, permitting the plug rods 212 of the side panels 21 to be forced into engagement with the plug holes 221 on the intermediate panel 22 respectively, and therefore the handle 2 is arranged into a substantially triangle bar (see FIG. 10). The transversely extended dented lines B are disposed adjacent to the rim 32 of the plastic container cap 3, therefore the handle 2 can be folded up and retained above the face panel 31 in parallel to the bowl 1 (see FIGS. 3, 5 and 6).

The plastic container cap 3, the bowl 1 and the handle 2 are made in integrity. The face panel 31 is connected between two raised side walls 311 within the rim 32. An elevation difference exists between the raised side walls 311 and the face panel 31. When the handle 2 is folded up and retained above the face panel 31, the handle 2 is maintained in flush or below the raised side walls 311 (see FIGS. 1 and 6), so that a plastic film 33 can be sealed to the plastic container cap 3 within the rim 32 to protect the bowl 1 and the handle 2 against contamination.

The face panel 31 of the plastic container cap 3 has a plurality of locating holes 312. When the handle 2 is folded up and retained above the face panel 31, the plug rods 212 are plugged into the locating holes 312 to secure the handle 2 in place (See FIGS. 3 and 5).

When the plastic film 33 is removed from the plastic container cap 3, the handle 2 is disconnected from the locating holes 312 on the face panel 31, and then the bowl 1 is disconnected from the face panel 31 by breaking the connecting portions 12, and then the side panels 21 are turned upwardly inwards toward each other, and then the plug rods 212 of the side panels 21 are engaged into the plug holes 221 on the intermediate panel 22, and thus the spoon is set up for use.

The plug rods 212 each have a rounded head 212 for positioning. When the rounded heads 212 of the plug rods 212 are forced into the plug holes 221 on the intermediate panel 22, the plug rods 212 become firmly retained to the intermediate panel 22.

Figure 9:
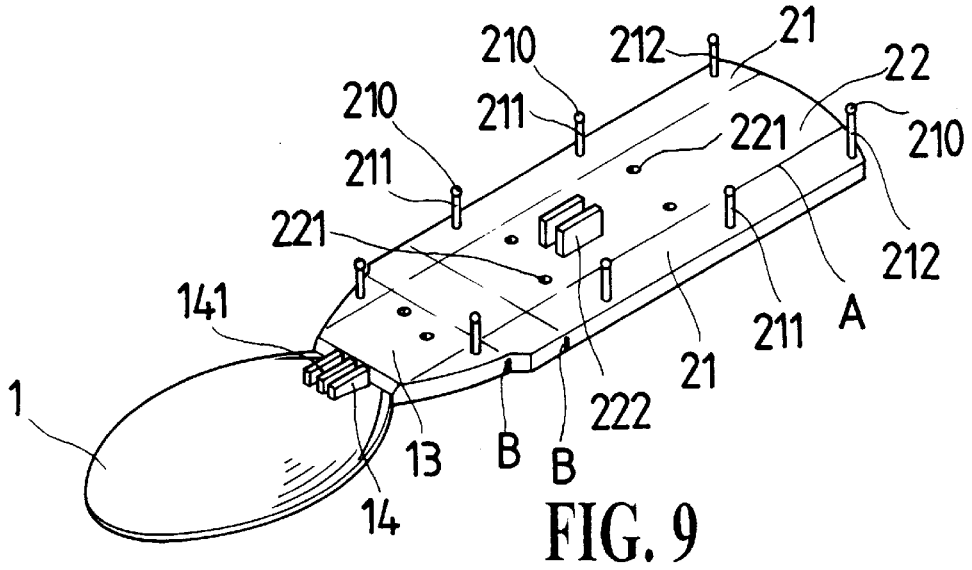
FIG. 9 is a perspective view of the spoon, showing the handle and the bowl extended out according to the present invention.

The bowl 1 has a plurality of flat rods 14 raised from the back side wall thereof adjacent to the neck 13, and arranged in parallel. The flat rods 14 define a plurality of parallel locating grooves 141. The intermediate panel 22 of the handle 2 has a plurality of flat blocks 222 raised from the front side wall thereof (see FIG. 9). When the handle 2 is folded up, the flat blocks 22 are forced into engagement with the locating grooves 141 (see FIGS. 5 and 6).

The aforesaid dented lines A;B are preferably respectively formed of a V-groove, so that the side panels 21 can be bent relative to the intermediate panel 22 and the handle 2 can be bent relative to the neck 13 of the bowl 1 smoothly without breaking the related parts.

The aforesaid embodiment of the present invention shows a spoon. However, the invention can be made in any of different forms of kitchen utensils. For example, a fork body 1' can be used instead of the aforesaid bowl 1 (see FIG. 1). The fork body 1' is peripherally reinforced with a peripheral flange 15'.

Figure 12:
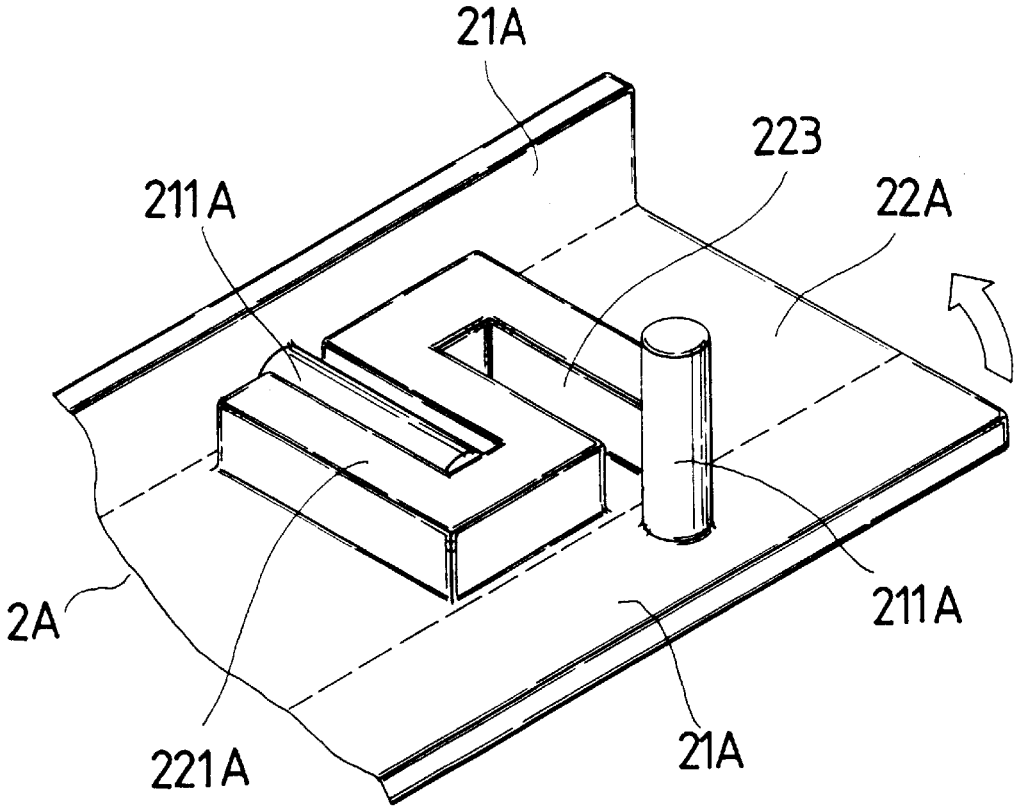
FIG. 12 is a perspective view in an enlarged scale of a part of an alternate form of the handle according to the present invention.
Figure 14:
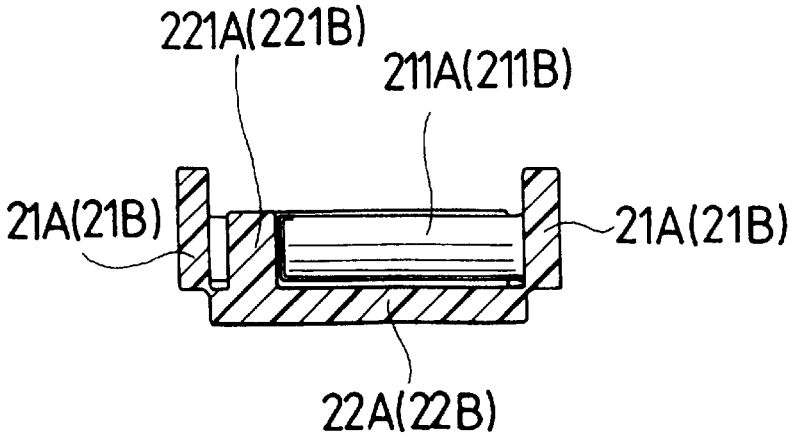
FIG. 14 is a sectional view showing the coupling rod engaged into the coupling groove in the coupling block according to the present invention.
Figure 13:
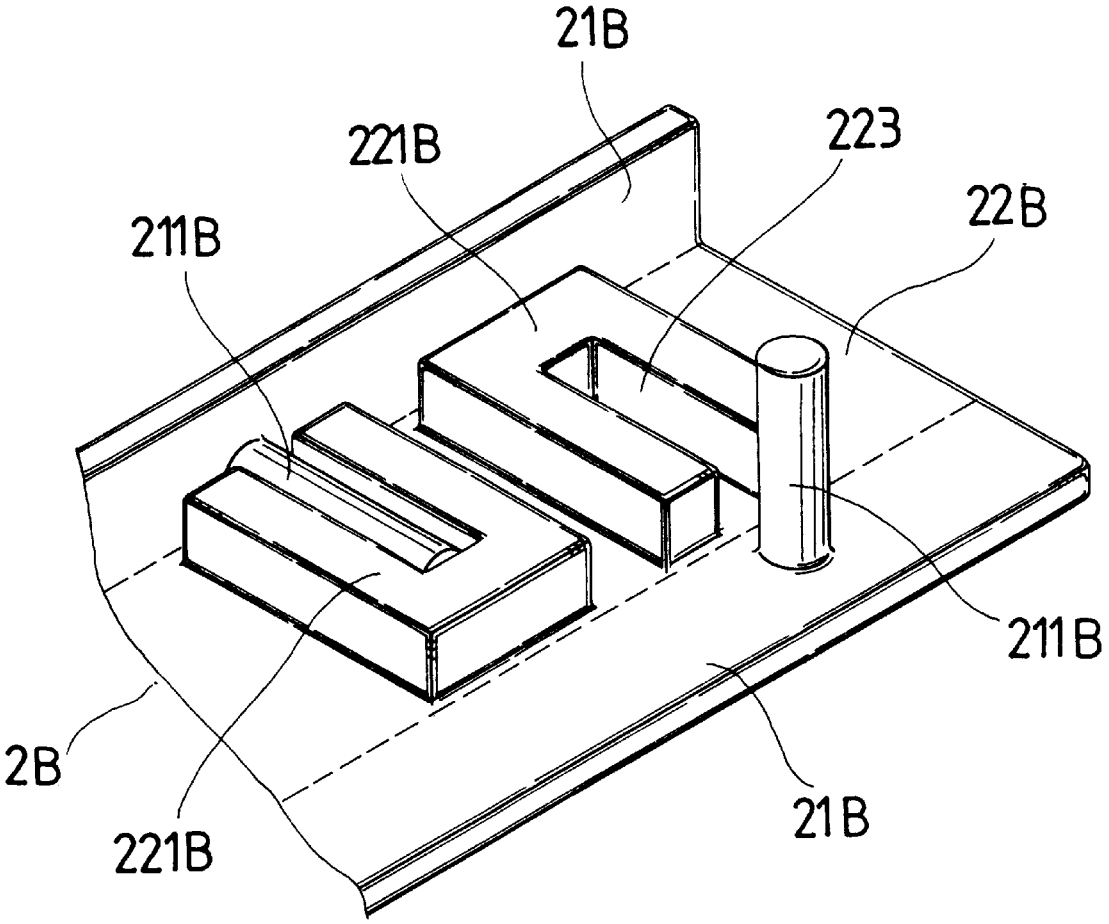
FIG. 13 is a perspective view in an enlarged scale of a part of another alternate form of the handle according to the present invention.

FIGS. 12, 13 and 14 show other alternate forms of the present invention. According to these alternate forms, the intermediate panel 22A or 22B of the handle 2A or 2B comprises at least one S-shaped or U-shaped coupling block 221A or 221B, the side panels 21A or 21B each have at least one coupling rod 211A or 211B for engaging into respective coupling grooves 223 in the coupling block 221A or 221B.

What the invention claimed is:

1. A plastic container cap comprising a cap body having a rim and a face panel suspended within said rim, a folding utensil formed of a utensil body and a handle and integral with said face panel of said cap body wherein said utensil body has a peripheral edge spaced from said face panel by a narrow opening and connected to said face panel by connecting portions in said narrow opening, and a neck at one end connected to said handle; said handle having dented lines through which said handle is folded up into a collapsed condition and attached to said face panel of said cap body at a top side above said utensil body, or folded into a three-dimensional profile for gripping by a hand.

2. The plastic container cap of claim 1 wherein said cap body comprises two raised side walls suspended within said rim at two opposite sides of said face panel, said raised side walls defining a receiving space above said face panel for receiving said handle.

3. The plastic container cap of claim 1, wherein said utensil body has a plurality of flat rods raised from a back side wall thereof adjacent to said neck and arranged in parallel, said rods defining a plurality of parallel locating grooves; the handle has a plurality of flat blocks raised from a front side wall thereof, said flat blocks of said intermediate panel being forced into engagement with the locating grooves on said utensil body when said handle is folded up and attached to said face panel of said cap body.

4. The plastic container cap of claim 1 wherein said utensil body is a bowl.

5. The plastic container cap of claim 1 wherein said utensil body is a fork.

6. The plastic container cap of claim 1 wherein said dented lines include two longitudinally extended dent lines and two transversely extended dent lines, said longitudinally extended dent lines dividing said handle into an intermediate panel and two side panels hinged to said intermediate panel at two opposite sides, said intermediate panel having a S-shaped coupling blocks raised from a front side wall thereof, said S-shaped coupling blocks each defining two reversely extended coupling grooves, said side panels each having a plurality of coupling rods, which are engaged into the coupling grooves in the S-shaped coupling blocks of said intermediate panel when said utensil body is detached from said face panel of said cap body and side panels are folded up, said transversely extended dented lines being arranged in parallel adjacent to the rim of said cap body and enabling said handle to be folded up and attached to said face panel of said cap body at a top side.

7. The plastic container cap of claim 1 wherein said dented lines include two longitudinally extended dent lines and two transversely extended dent lines, said longitudinally extended dent lines dividing said handle into an intermediate panel and two side panels hinged to said intermediate panel at two opposite sides, said intermediate panel having pairs of reversely extended U-shaped coupling blocks raised from a front side wall thereof, said U-shaped coupling blocks each defining a coupling groove, said side panels each having a plurality of coupling rods, which are engaged into the coupling grooves in the U-shaped coupling blocks of said intermediate panel when said utensil body is detached from said face panel of said cap body and side panels are folded up, said transversely extended dented lines being arranged in parallel adjacent to the rim of said cap body and enabling said handle to be folded up and attached to said face panel of said cap body at a top side.

8. The plastic container cap of claim 1 wherein said dented lines include two longitudinally extended dent lines and two transversely extended dent lines, said longitudinally extended dent lines dividing said handle into an intermediate panel and two side panels hinged to said intermediate panel at two opposite sides, said intermediate panel having a plurality of plug holes, said side panels each having a plurality of plug rods, which are engaged into the plug holes on said intermediate panel when said utensil body is detached from said face panel of said body and side panels are folded up, said transversely extended dented lines being arranged in parallel adjacent to the rim of said cap body and enabling said handle to be folded up and attached to said face panel of said cap body at a top side.

9. The plastic container cap of claim 8 wherein the plug rods of said side panels each have a rounded head.

10. The plastic container cap of claim 8 wherein said face panel of said cap body has a plurality of locating holes for receiving the plug rods of said side panels of said handle when said handle is folded up and attached to said face panel.

11. The plastic container cap of claim 10 wherein the plug rods of said side panels each have a rounded head.

* * * * *